US009135796B2

(12) United States Patent
Kalo et al.

(10) Patent No.: US 9,135,796 B2
(45) Date of Patent: Sep. 15, 2015

(54) INTRUSION DETECTION SYSTEM AND ITS SENSORS

(75) Inventors: Arie Kalo, Ness-Ziona (IL); Nir Gilboha, Kfar Ha'nagid (IL)

(73) Assignee: Sabra De-Fence Technologies Ltd., Tel Aviv (IL)

( * ) Notice: Subject to any disclaimer, the term of this patent is extended or adjusted under 35 U.S.C. 154(b) by 642 days.

(21) Appl. No.: 12/994,645

(22) PCT Filed: May 27, 2009

(86) PCT No.: PCT/IL2009/000531

§ 371 (c)(1),
(2), (4) Date: Jan. 4, 2011

(87) PCT Pub. No.: WO2009/144724

PCT Pub. Date: Dec. 3, 2009

(65) Prior Publication Data

US 2011/0102178 A1 May 5, 2011

(30) Foreign Application Priority Data

May 27, 2008 (IL) ..... 191755

(51) Int. Cl.
*G08B 13/12* (2006.01)
*G08B 25/10* (2006.01)

(52) U.S. Cl.
CPC ..... *G08B 13/122* (2013.01); *G08B 13/126* (2013.01); *G08B 25/10* (2013.01)

(58) Field of Classification Search
USPC ..... 340/541, 548, 565–567, 502, 511, 514, 340/524, 517, 521, 550–552
See application file for complete search history.

(56) References Cited

U.S. PATENT DOCUMENTS

| | | | | |
|---|---|---|---|---|
| 4,500,873 | A * | 2/1985 | Porat et al. | 340/515 |
| 4,540,979 | A * | 9/1985 | Gerger et al. | 340/576 |
| 4,622,541 | A * | 11/1986 | Stockdale | 340/566 |
| 4,829,287 | A | 5/1989 | Kerr | |
| 4,831,558 | A * | 5/1989 | Shoup et al. | 702/188 |
| 5,103,207 | A | 4/1992 | Kerr | |
| 5,132,716 | A * | 7/1992 | Samuels et al. | 396/622 |
| 5,239,459 | A * | 8/1993 | Hunt et al. | 700/90 |
| 5,302,945 | A * | 4/1994 | Stoltenberg | 340/660 |
| 5,329,027 | A | 7/1994 | Gojon-Zorrilla | |
| 5,602,534 | A | 2/1997 | Granat | |
| 5,857,986 | A * | 1/1999 | Moriyasu | 601/49 |
| 5,914,655 | A * | 6/1999 | Clifton et al. | 340/506 |
| 6,243,654 | B1 * | 6/2001 | Johnson et al. | 702/85 |
| 6,564,637 | B1 * | 5/2003 | Schalk et al. | 73/504.12 |

(Continued)

OTHER PUBLICATIONS

International Search Report and Written Opinion of PCT/IL2009/000531 dated Sep. 18, 2009 (11 pages).

*Primary Examiner* — Firmin Backer
*Assistant Examiner* — Nay Tun
(74) *Attorney, Agent, or Firm* — Rodney J. Fuller; Booth Udall Fuller, PLC

(57) ABSTRACT

An intrusion detection system, that comprises a multi sensors array deployable along a physical barrier means and linkable to it in a manner that enables sensing various phenomena (one or more), typically take place when an attempted intrusion act occurs through the physical barrier means, and generation of an indication when such a phenomenon is sensed, characterized by that, that at least in one of the sensors there is installed a processing component that belongs and is specifically allocated to the sensor and enables local analyzing of the sensed phenomena within said sensor.

18 Claims, 11 Drawing Sheets

(56) References Cited

U.S. PATENT DOCUMENTS

Figure 1:
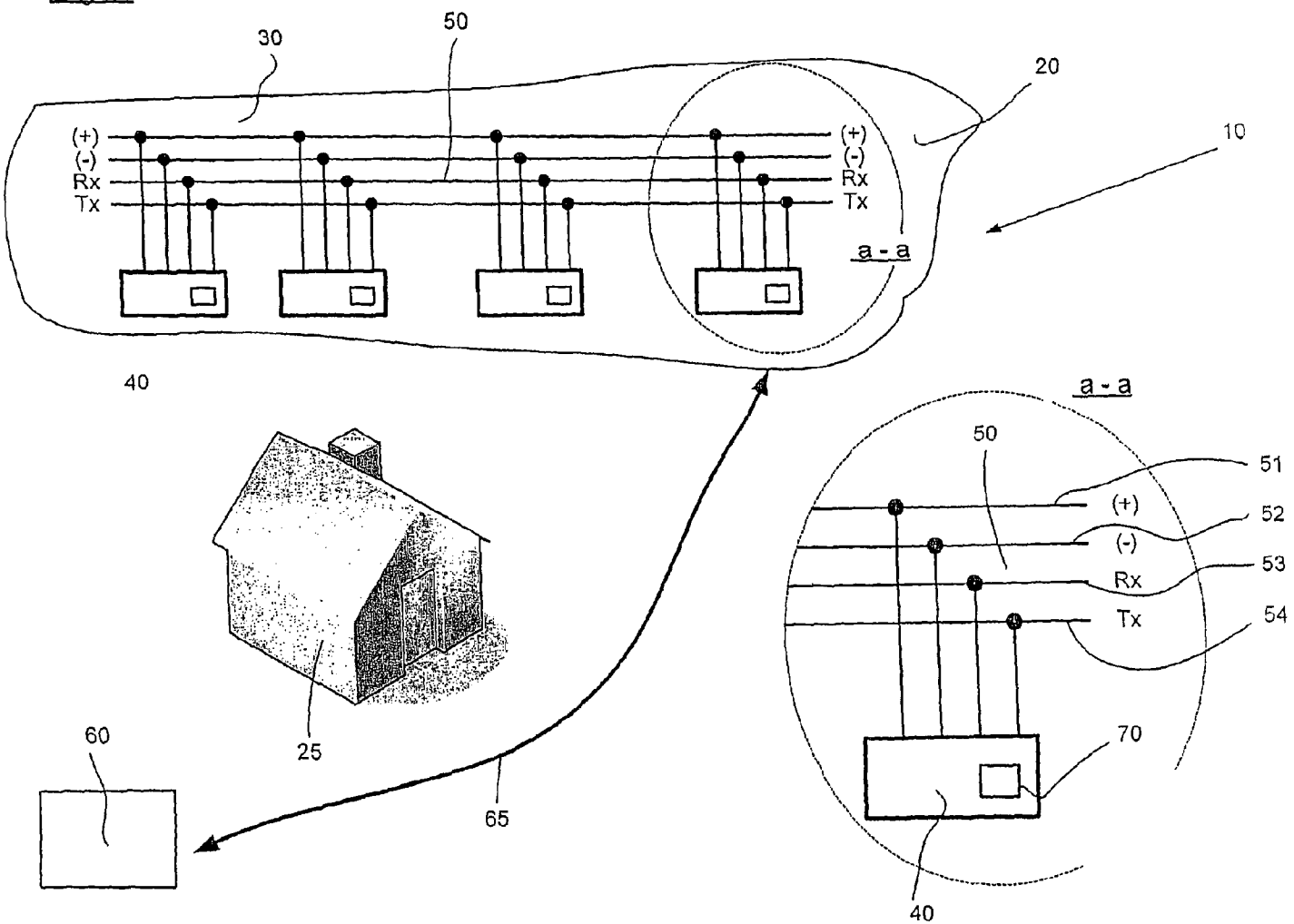

| | | | | |
|---|---|---|---|---|
| 6,646,653 | B2 | 11/2003 | San | |
| 6,737,972 | B1 | 5/2004 | Gitlis | |
| 7,067,748 | B1 | 6/2006 | Kelley, Jr. | |
| 7,184,907 | B2 * | 2/2007 | Chun | 702/69 |
| 7,508,304 | B2 * | 3/2009 | Swanson | 340/541 |
| 2002/0007660 | A1 | 1/2002 | Brown | |
| 2006/0239603 | A1 | 10/2006 | Patel | |
| 2006/0262646 | A1 | 11/2006 | Horak | |
| 2007/0008123 | A1 * | 1/2007 | Swanson | 340/541 |

* cited by examiner

INTRUSION DETECTION SYSTEM AND ITS SENSORS

RELATED APPLICATION DATA

This application is the U.S. national stage of PCT/IL2009/000531, filed May 27, 2009, which claims priority to Israeli Patent Application No. 191755, filed May 27, 2008, the contents of each of which are herein incorporated by reference for all purposes.

FIELD OF THE INVENTION

The present invention refers to security systems and more particularly is found in the field of intrusion detection systems and sensors implemented in such systems.

BACKGROUND OF THE INVENTION

The challenge of protecting strategic enclosures and desolated long border lines is known from days yore. Partly, the problem is alleviated by erecting a physical barrier means around the perimeter of the enclosure or along the border line—for example by building a massive wall or by deploying a robust fence means or other known similar means.

Also well known are systems for detecting attempts to overcome such barriers that are performed by penetrating through the physical barrier means or climbing and crossing over it. These systems generate and send suitable warning signals in real time to a remote control center, providing also the location (to within a limited accuracy) of the whereabouts of the attempted break in.

Such systems comprise an array containing plurality of sensors (dubbed multi sensors array) that is deployed along the physical barrier means and linked to it in a manner that enables sensing via the array, of one or more occurrence/s (or in other words—typical phenomena), that takes place when there is an attempted penetration through the physical barrier means or by climbing on and over it and generating (producing) an indication when such an occurrence is actually sensed.

For example—

An array of sensors such that those that are close to the attempted penetration location sense the occurrence of vibrations and shocks that naturally accompany the breaking in and cutting of the grid (in a grid type of physical barrier), or, another example—

An array of sensors that, once more, are adjacent to the site of the incident and "feel" (detect) the phenomena of variations in the tension of the wires, that naturally accompanies cutting, sawing of—or climbing on—the taut stretched wires (when the physical barrier means is a taut wires type of fence).

When sensing an attempted penetration as said, a transmission means that is coupled to the sensors array routes and leads the indications generated by the sensor/s (one or more) that are adjacent to the site of the incident to a remote locality (point), unto a control center that receives the indication and in its turn generates—at times after performing first an analysis of the received indication and subject to it, a warning reporting the occurrence of an attempted intrusion, through the above cited physical barrier or by climbing on and over it.

Such systems and sensor means that serve in them where published and described in the past, including—as well, in documents of old patents. For example—

U.S. Pat. No. 4,829,287 of Kerr et al, that described in a taut wire type of intrusion detection system, a system wherein each parallel wire defines a section of a security fence and is tensioned between a pair of wire-supporting vertical anchor posts. Intermediate the anchor posts there is provided in accordance to Kerr's patent, a row of regularly spaced vertical detector posts each presenting a plurality of individual sensors, each associated with one of the taut stretched wires and operable to produce a sensor's signal when the tension of the wires changes. With each detector post there is associated sensor signal processing means, operable to analyze the sensor signals produced by the sensors of the detector post in response to changes in tension of the taut wires, and to generate output signals correlatable with the sensor signals. Each sensor preferably includes additionally a pressure transducer comprising a partially conductive compressible elastic sensing element whose resistance changes with applied pressure.

U.S. Pat. No 5,103,207—also of Kerr et al, describes a sensor post formed with a hollow interior and a semi-rigid surface which flexes in response to an applied force. Sensor bars are mounted to the semi-rigid surface in a cantilevered fashion, and include an intermediate electrically insulated section located inside the interior of the sensor post. The sensor element mounting means is rigidly mounted to a portion of the sensor post which remains essentially stationary during an intrusive event. Sensing elements are made of a flexible semi-conductive sensing material, whose resistance increases when the material is stretched, and are mounted so as to straddle an electrically insulated section of the sensor bars. A signal analysis means detects an increase in the resistance of the sensing elements and generates an alarm. A wire guiding device uses a separator bar shaped into a zig-zag configuration which is provided with a series of apertures forming an axial channel, and a locking rod dimensioned for insertion into the axial channel formed in the separator bar, thereby entrapping the taut wires.

U.S. Pat. No. 5,329,027 of Brunot et al, described a taut wire perimeter fence intrusion detection system. The taut wire deflection sensors in the system each include a flexible housing into which is disposed a full resistance bridge having strain gages for each leg. Opposing strain gages in the bridge circuit have predominant directions in common directions. The strain gages are formed directly onto a printed circuit board. An amplifier circuit is also mounted onto the circuit board, for amplifying the differential bridge voltage from the bridge. The taut wire is connected to the housing, for example by way of a slotted bolt and nut, so that horizontal deflection of the taut wire creates strain on the circuit board which is sensed by the strain gage bridge, amplified by the amplifier, and communicated to a data processing system which generates the appropriate alarm condition.

U.S. Pat. No. 5,602,534 of Granat described a sensor for use in an electrical security fence, comprising an electrically conductive housing completely enveloping an electronic component so as to screen the electronic component from electromagnetic radiation whilst permitting movement of the electronic component relative to the housing when acted upon by an external force. According to a preferred embodiment, the electronic component is a deflection sensor or taut wire sensor, such that the sensor is completely shielded from the atmospheric effects and stray radiation.

Buckley et al, in U.S. Pat. No. 6,646,653 described a deflection sensor for a taut wire perimeter fence detection system, which can be installed after the fence wire has been installed easily, and the sensor that operates in line with the wire tension. The sensor includes a plate member adapted to be pivotally mounted, a first wire attachment point at one end of said plate member, a second wire attachment point remote from said first wire attachment point and a transducer or sensor element located on said plate member between the attachment points. The taut wire type detection system including at least one taut wire for a perimeter fence supported by a plurality of posts, at least one deflection sensor being pivotally mounted to one of the posts or a support thereon and a sensor processing circuit for interrogating the at least one deflection sensor and to provide an alarm indication on tampering of the at least one taut wire or the at Yeast one deflection sensor.

U.S. Pat. No. 6,737,972 of Gitlis, described a vibration sensor that is used in conjunction with perimeter security systems. The sensor is comprised of two conductive spherical elements each resting on a pair of parallel conductive arcs. A plurality of sensors are attached to mounting device and placed at spaced intervals on a security fence. The sensors are used to detect persons who attempt to cut, climb, lift, or contact the security fence.

However, these prior art systems suffer from a number of disadvantages. Primary among those are—

Lack of immediate capability to perform calibrations and alterations of the thresholds of sensitivity, individually—both individual and specific—of the sensor units, let alone perform it remotely (from the control system), without having to approach the sensor or to physically open or dismantle it.

In other words, systems in accordance with the prior art are not decentralized from the point of view of the control and command (availability) over the sensor components that are assembled in them.

Sensors in accordance with the known prior art do not include, each one of them a processing component (for example—a component of the micro processor type), individually of his own, and hence, they do not enable, for example—remotely approaching each individual sensor with specific commands and/or data, implementation of an individual and specific algorithm in each one of them, nor dividing the protected area into sectors with different sensitivities or performing variations in the calibrations at the specific sensor (unique) level.

This means that there exists a deficiency that causes, of course—a reduction in the available sensitivity in said systems that are in accordance with the prior art, and as a consequence, also disrupts (harms) their reliability.

An additional drawback found in earlier systems as per prior art documentation, is the inability to perform serviceability tests while employing a self excitation method remotely in order to generate the same phenomena themselves as the sensor unit does actually sense when an attempted penetration act is being made. This is rather performed today in the cumbersome—and at times even dangerous way of sending a person to rock, bend or shake the various fence sectors.

Yet another drawback found in earlier systems as per the prior art, is the lack of ability to integrate several types of sensors—such that they implement various detection technologies different from one another, rendering the system to be an integral system operating over a single communication line.

Systems as per the prior art are characterized by the uniformity from the aspect of the sensors types that are installed in them, and by lack of diversity and combinations of applying several types of sensors into one system (wherein each addition of a sensors type mandates the need to add a dedicated, special transmission line for it).

Obviously, such uniformity exposes the system to relatively easy trials to disrupt it—as then the intruder has to cope with only one kind of sensor that he has to overcome (or neutralize).

The complexity that is thus forced on systems as per prior art, as said, renders the system to be more expensive and also adds to its constructional and maintenance complexity.

Systems as per prior art, do not provide the capability of easy and convenient available (accessible) interfacing with commercial alarm systems that abound in the market (for example in the private or industrial markets). The customer might desire to integrate the system with an existing commercial alarm system in his disposal, and this ability is not offered by systems that are as per the above cited prior art.

SUMMARY OF THE INVENTION

The present invention is an intrusion detection and warning system that overcomes the deficiencies and drawbacks that abound, as described above, in the existing intrusion detection systems and their sensors as per prior art.

An intrusion detection system in accordance with the present invention is a decentralized system from the aspect of its computerizing capability and characterized by a processor component that is installed in each of its sensors. This characteristic feature, namely—decentralization of the computerizing capability of the system down to the single sensor level, increases the sensitivity of the system to better sense the penetration attempt and to warn of it and as well improves the system's reliability as compared to the systems in accordance with the prior art. This improved performance is the result of decentralizing the processing components of the system down to the single sensor level, for example—new capabilities of performing calibrations and altering the thresholds of sensitivity, individually—individual and specific, at the sensor unit proper, remotely from the control center and without having to physically approach the sensor or to dismantle it, implementation of an individual detailed algorithm in each one of the sensors, partitioning the system to sectors having different sensitivities and more.

Hence, in one aspect of the present invention, we note that it is an intrusion detection system that is characterized by that that at least in one of the sensors installed in it (and preferably in all of them), there is installed a processing component that is allocated and attributed to it and enables localized processing of the sensed data of said sensor.

Yet, in another aspect of the present invention, as per the manner of operation of a system that would be in accordance with the invention, there is also embodied a general method for detecting intrusion, wherein the method is characterized by that that identification of one incident or more, as such that happens when attempted intrusion through the physical barrier means or by climbing over it is sensed, such identification is performed by applying an algorithm that resides in the processing component that is installed in at least one of the sensors which is mounted in the system.

In a preferred embodiment of a system which is in accordance with the invention, wherein in the system there are installed vibration sensors, the system enables remote performance of serviceability tests and/or examinations while employing a self excitation unit resident in the system itself, to generate the same phenomena themselves as the sensor unit does actually sense when there is an actual penetration attempt. Such examinations can be performed routinely and automatically by utilizing a commanding in the control station that communicates with the individual sensors.

An added advantage of an intrusion detection system in accordance with the present invention is its relative immunity from attempts to disrupt it. This is achieved as the outcome of the capability of the system to integrate in it a combination of several sensors that implement different detecting technologies from one another, and yet to continue to operate them in a relative low priced manner, over one and single transmission line.

An additional advantage of an intrusion detection system in accordance with the present invention is the capability of the system to interface with common commercial alarm systems that abound in the market, hence rendering it attractive to owners of such common alarm systems who wish to upgrade them.

BRIEF DESCRIPTION OF THE ACCOMPANYING FIGURES

The present invention will be described herein in conjunction with the accompanying figures. Identical components, wherein some of them are presented in the same figure—or in case that a same component appears in several figures, will carry an identical number.

FIG. 1 constitutes an illustration of an example of an intrusion detection system in accordance with the present invention.

Figure 2:
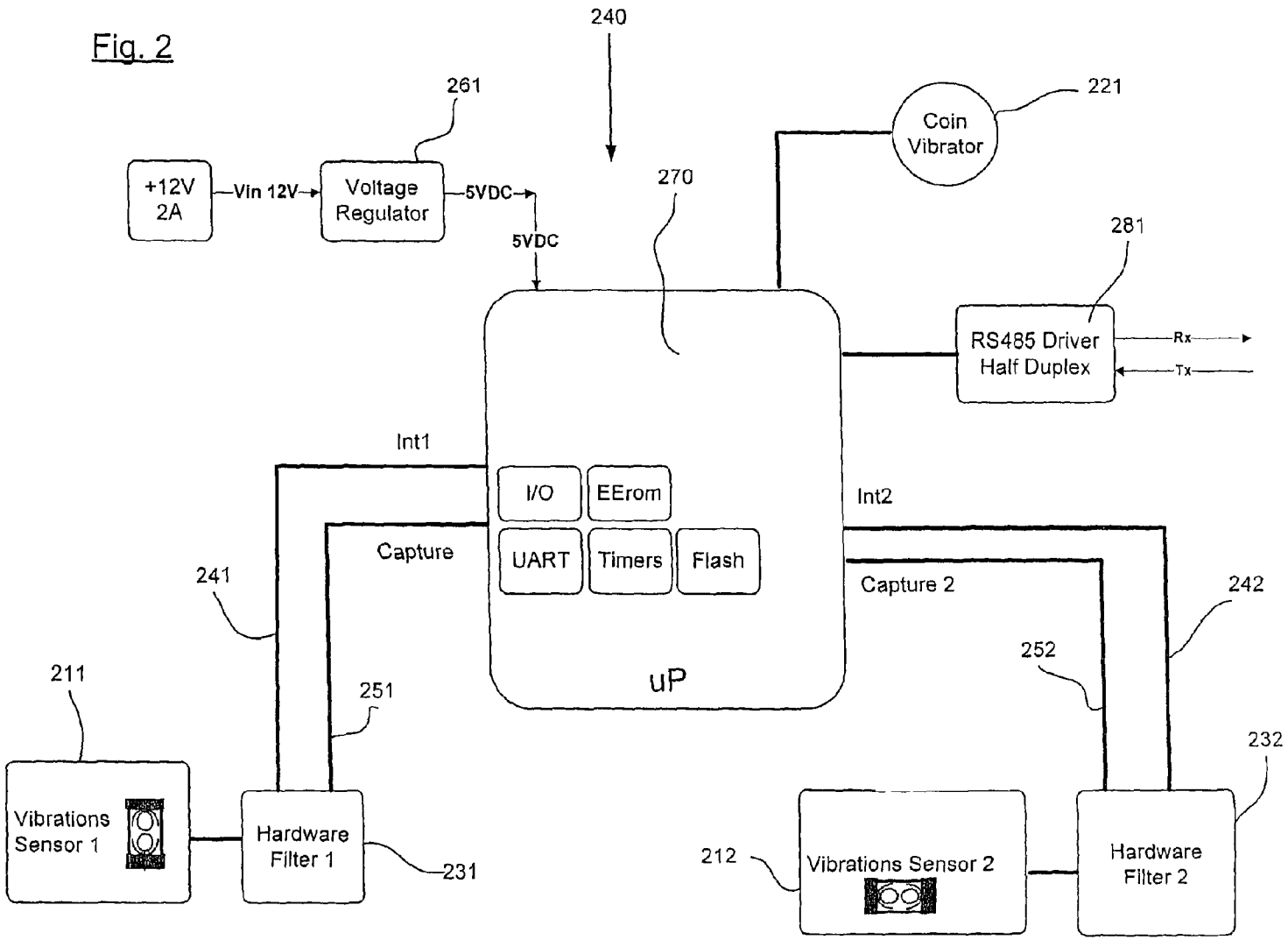

FIG. 2 constitutes a schematic view at the block diagram level of an example structure of a sensor for sensing vibrations that might serve in an intrusion detection system in accordance with the present invention.

Figure 3:
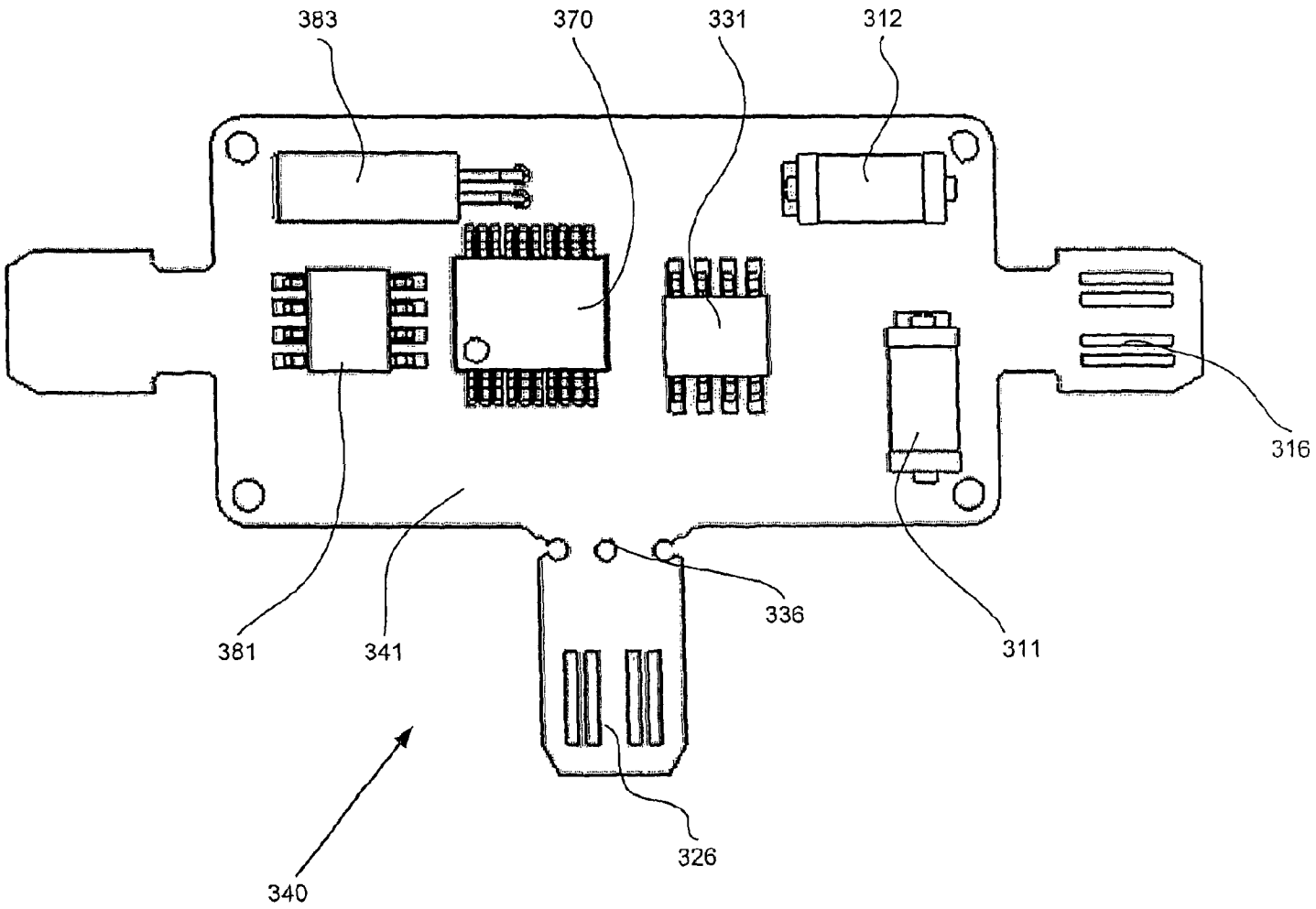

FIG. 3 constitutes a front view of a sensor for sensing vibrations as in the example that was illustrated in FIG. 2, wherein it is provided on a printed circuit.

Figure 4:
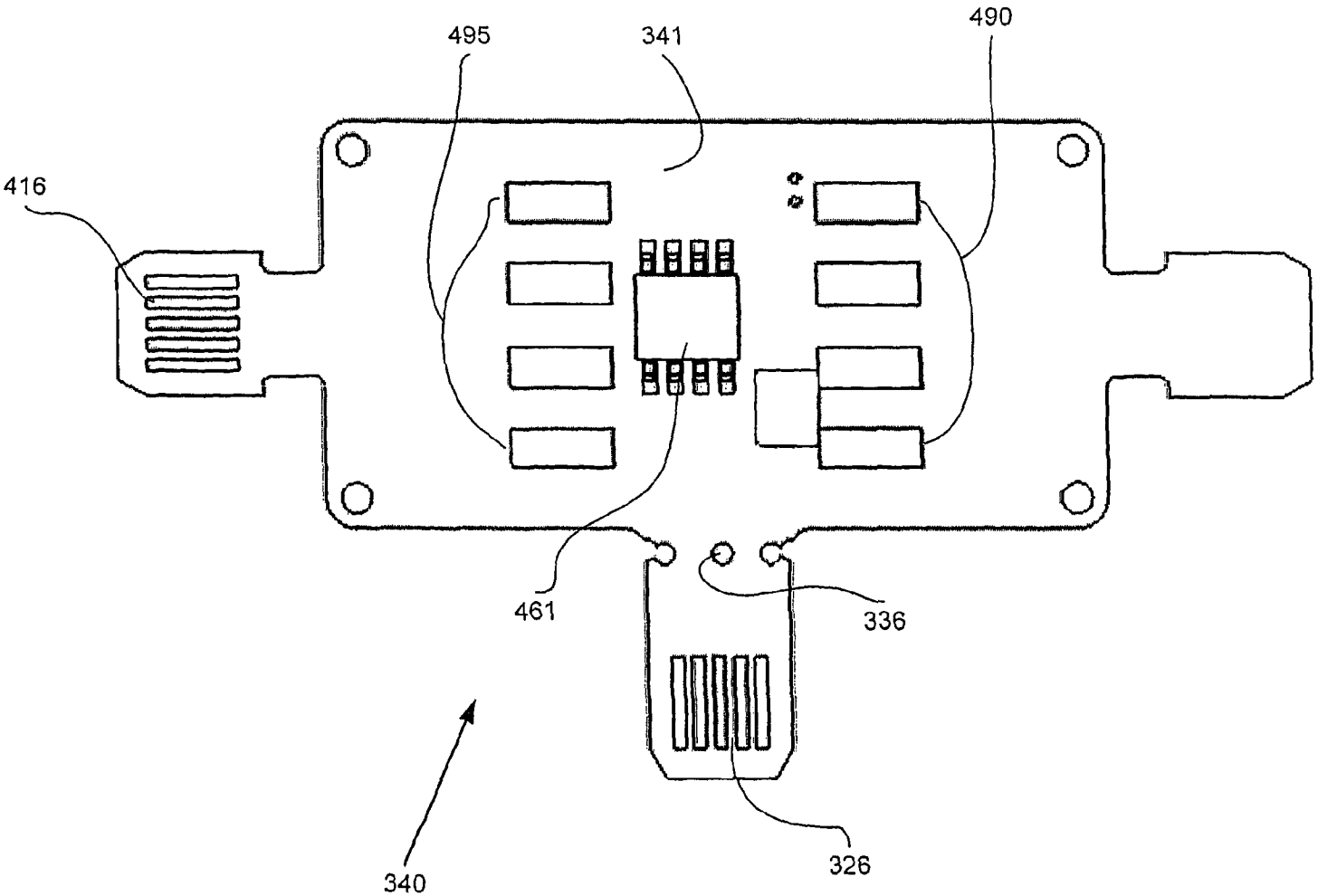

FIG. 4 constitutes a rear view of the same printed circuit that on it the sensor for sensing vibrations (that is illustrated in FIG. 3), is provided.

Figure 5:
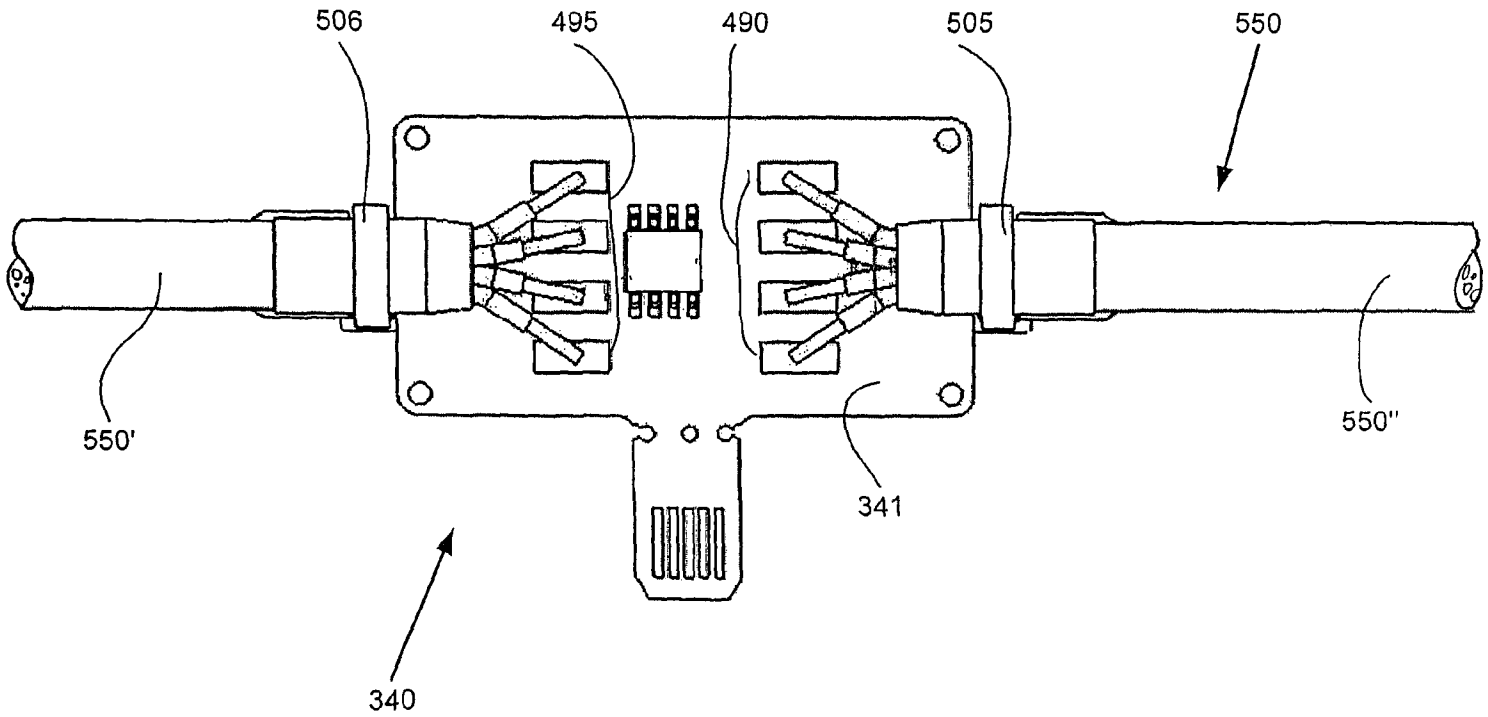

FIG. 5 constitutes a view of the printed circuit that upon it, the sensor for sensing vibrations that is illustrated in FIGS. 3 and 4 is encapsulated, wherein it is linked with a line type of transmission means.

Figure 6:
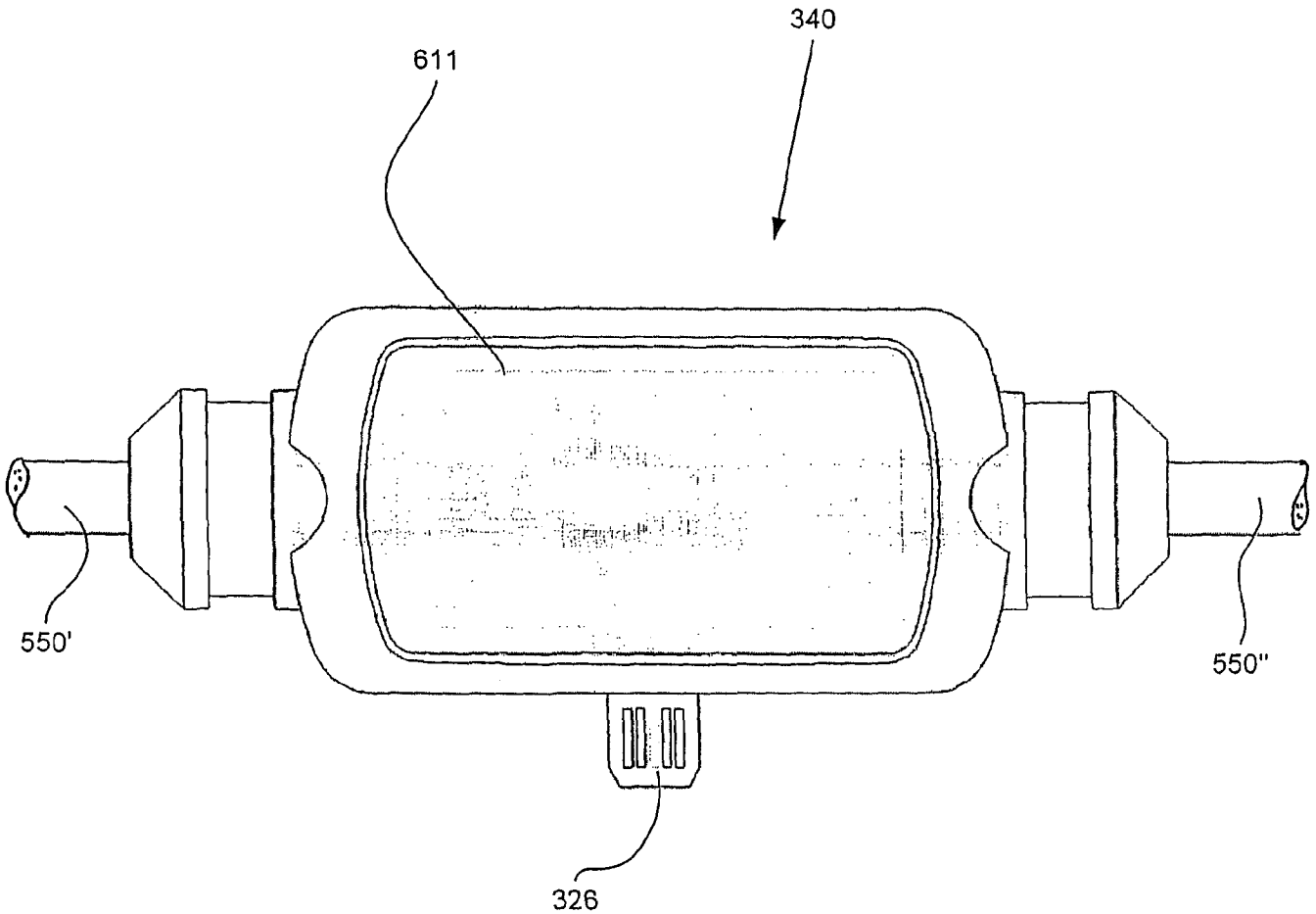

FIG. 6 constitutes a view of the sensor for sensing vibrations whose components (provided on a printed circuit) were illustrated in FIGS. 3 and 4 and its view wherein it is linked with a line type transmission means was illustrated in FIG. 5 wherein it is encapsulated inside polymeric material that was cast all around it.

Figure 7:
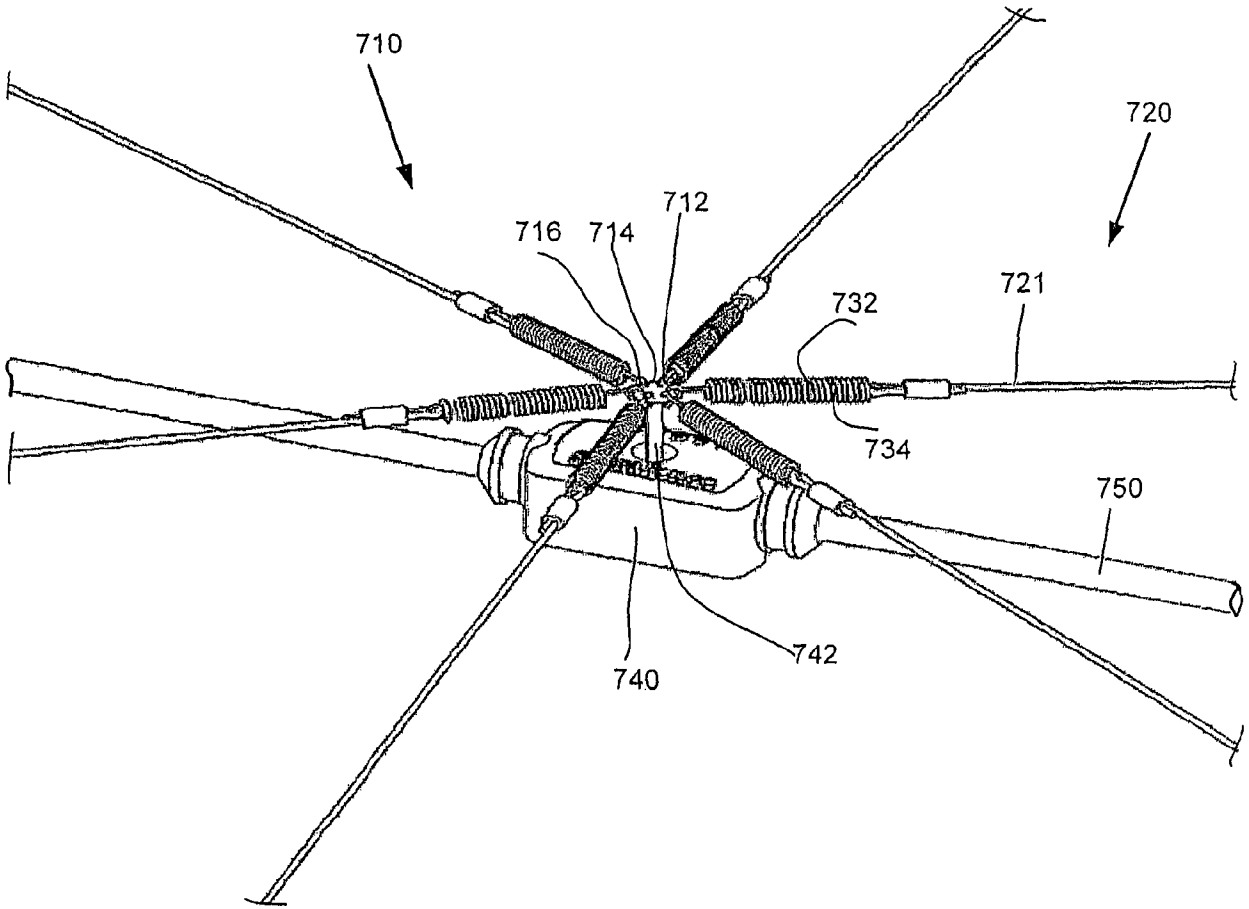

FIG. 7 constitutes an illustration of an intrusion detection system in accordance with yet additional embodiment of the present invention, in which a sensor for sensing strain changes that is based on a strain gage device is integrated with a spatial array of taut wires.

Figure 8:
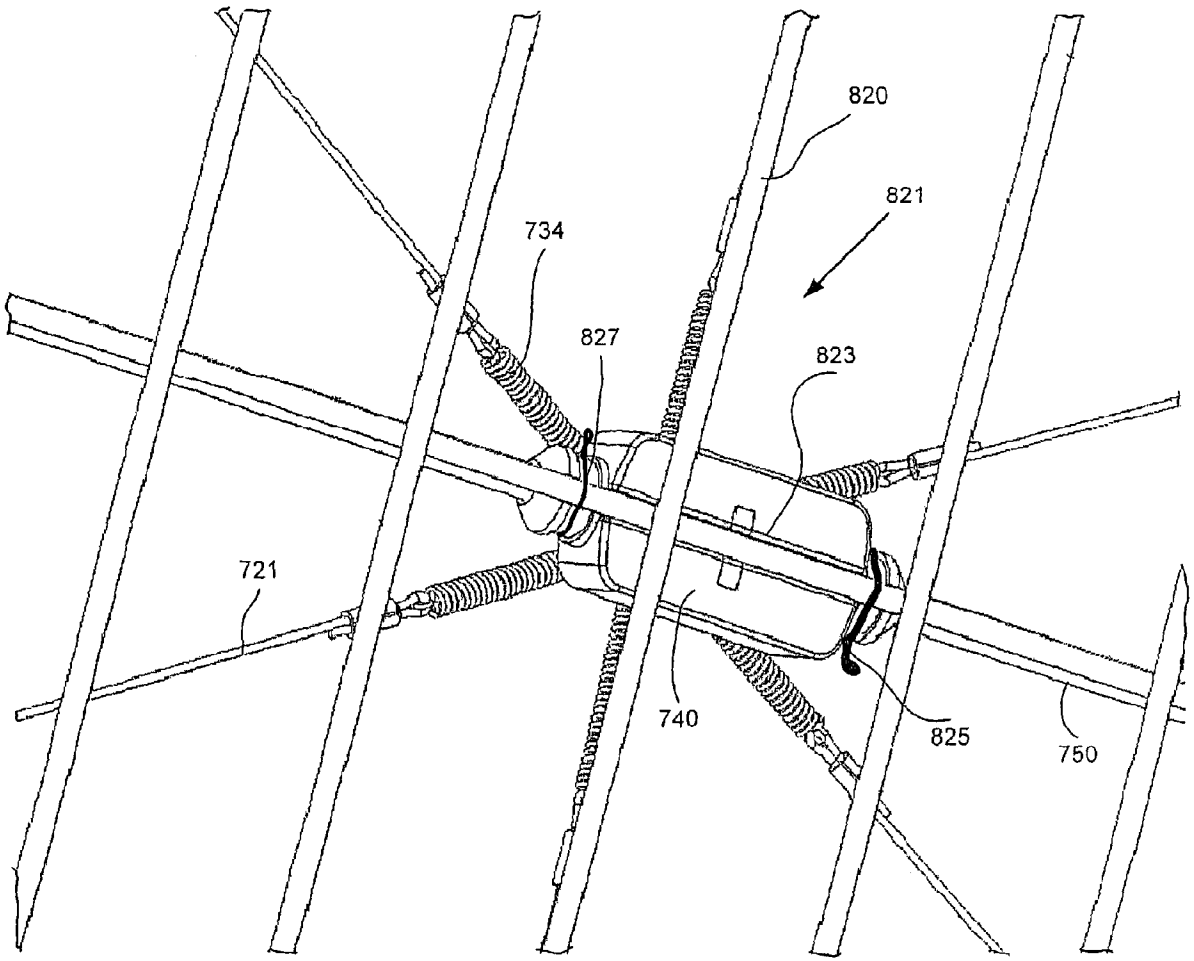

FIG. 8 constitutes an illustration of the intrusion detection system that was illustrated in FIG. 7, wherein it is installed on a rigid wires grid type physical barrier.

Figure 9:
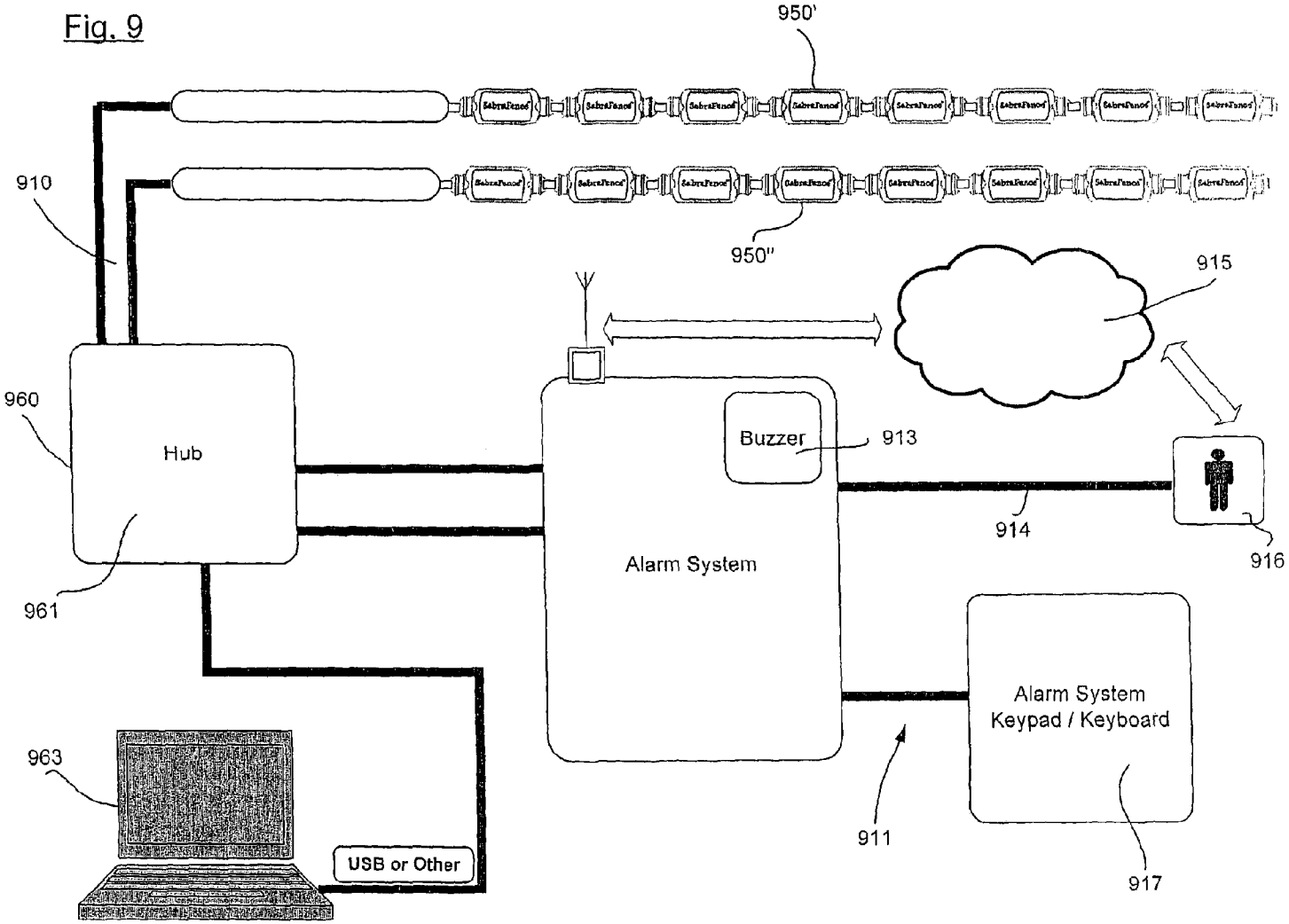

FIG. 9 constitutes an illustration of an additional embodiment of an intrusion detection system in accordance with the present invention, wherein the system is integrated with an existing alarm system.

Figure 10:
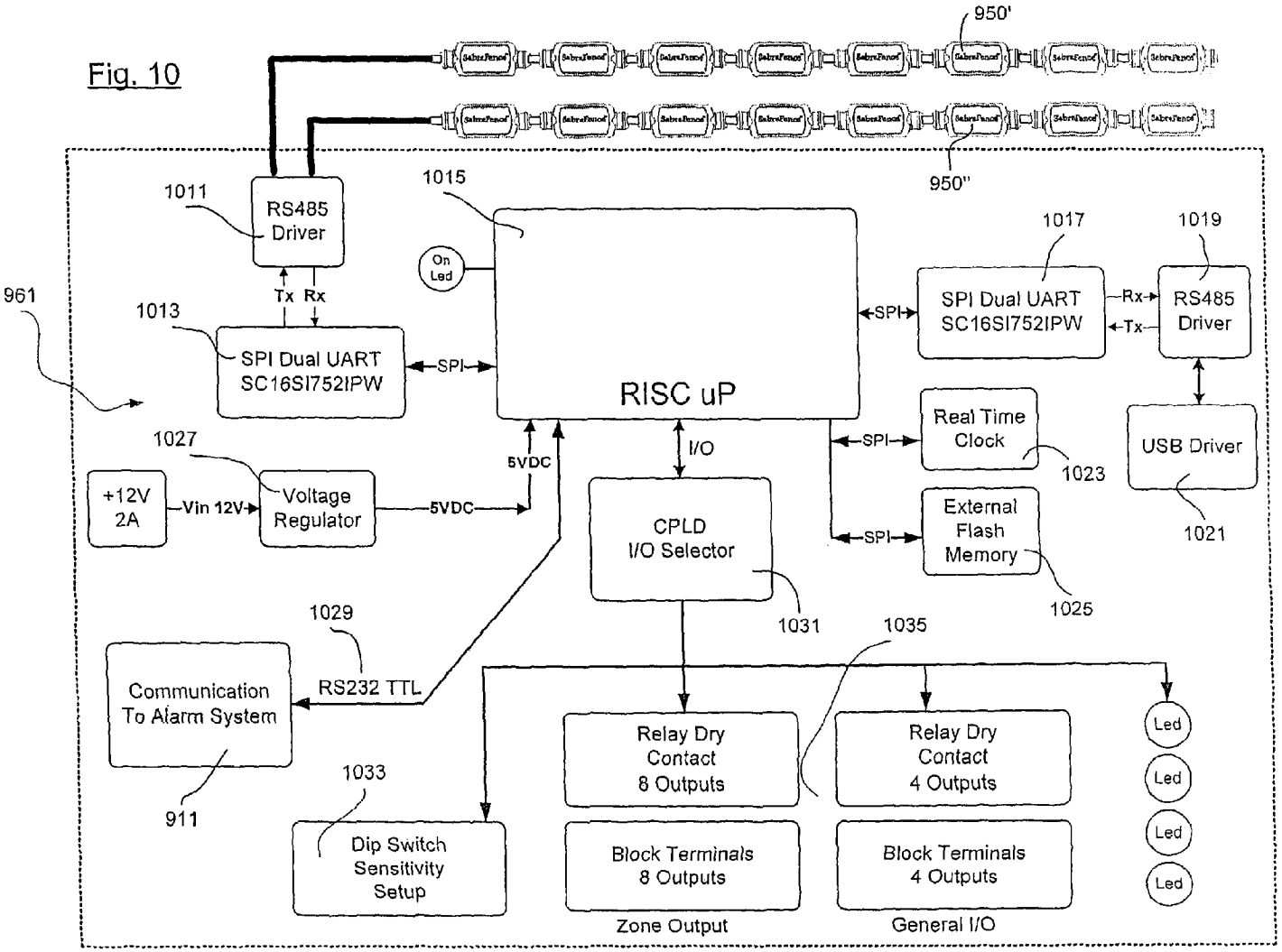

FIG. 10 constitutes a schematic view at the block diagram level of an example structure of an adapter means that enables interfacing of an intrusion detection system with an existing alarm system (as illustrated in FIG. 9).

Figure 11:
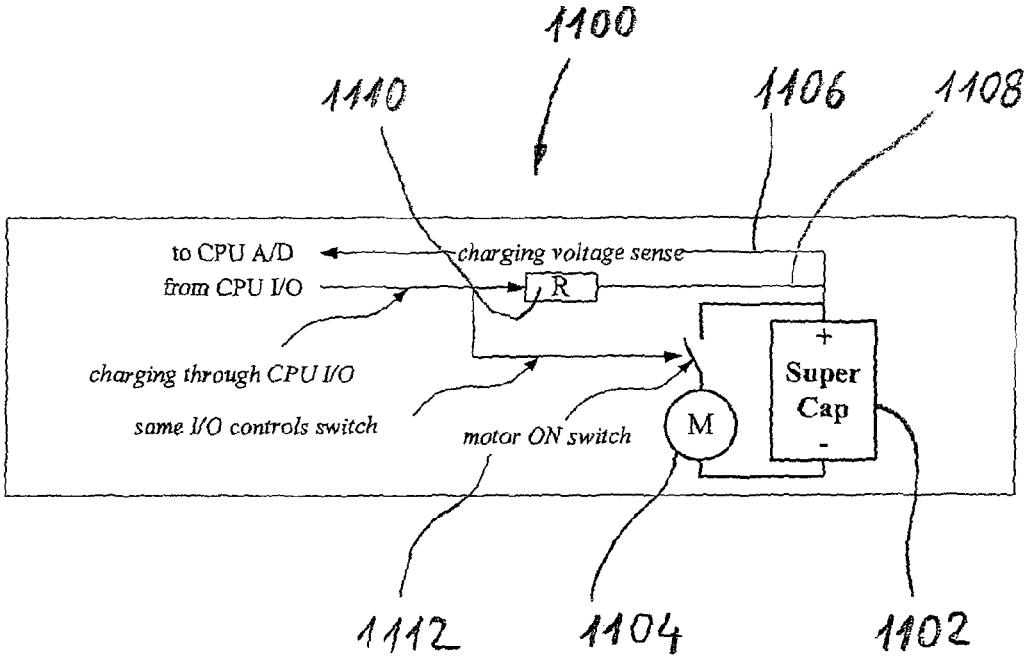

FIG. 11 constitutes a schematic view at a block diagram of means for performing active initiated self test by generating vibrations (illustrated in a "motor ON" open switch position).

Figure 12:
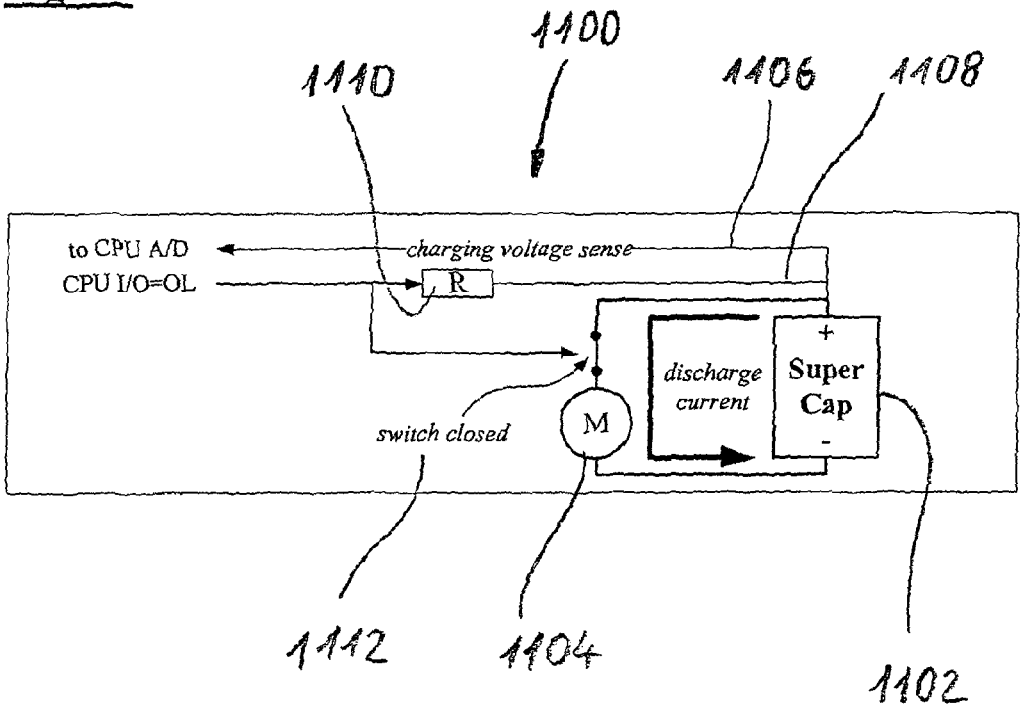

FIG. 12 constitutes a schematic view at the block diagram of constitutes a schematic view at a block diagram of means for performing active initiated self test by generating vibrations (illustrated in a "motor ON closed switch position).

DETAILED DESCRIPTION OF A PREFERRED EMBODIMENT OF THE PRESENT INVENTION

Reference is being made to FIG. 1. FIG. 1 constitutes an illustration of an example of an intrusion detection system 10 in accordance with the present invention.

Intrusion detection system 10 comprises a physical barrier means 20. Any professional would understand that the physical barrier means 20 might be for example, a massive wall around the perimeter of the enclosure or robust fence means made of taut wires, a rigid grid type fence or similar means.

Physical barrier means 20 is depicted wherein it is positioned around the perimeter of enclosure 25 (and any professional would understand that, in the same manner, physical barrier means 20 might be deployed along a border line, a train railway, an oil pump or any type of strategic site—similarly intended to prevent penetrations).

An intrusion detection system 10, comprises in addition, also an array 30 equipped with a plurality of sensors (herein after "multi sensors array" 40). Array 30 is illustrated as it is deployed along physical barrier means 20 and linked to it. As will be explained later on and in accordance with the illustrated example, sensors 40 enable sensing the phenomena of shocks and vibrations that naturally occur when an intrusion attempt through physical barrier means 20 or attempting break in by climbing over it, is taken place. Sensors 40 enable the generation of an appropriate indication when such a sensing has been noted, as said.

The intrusion detection system 10 comprises in addition a line type of transmission means 50 that is coupled with array 30 of sensors 40. As will be explained later on and in accordance with the illustrated example, transmission means 50 serves, inter alia, for routing the indications that are received when a phenomenon of shocks and vibrations is sensed.

An intrusion detection system 10 comprises in addition a control system 60. In the illustrated example, control system 60 can be located in a substantial distance from the physical barrier means 20.

Control system 60 is linked to transmission means 50 (in the illustrated example—observe arrow 65), for receiving the indications that are generated when an intrusion attempt is happening through physical barrier means 20 or by climbing over it, and in order to produce a warning about the attempted intrusion.

As can be seen in the enlarged inset marked a-a in FIG. 1, a characteristic of system 10 is the fact that each one of sensors 40 is integrally embedded with its own processing component 70 that is attributed to it. Processing component 70 might be of a micro processor type, or a micro controller, a DSP or any similar component.

As can also be seen in FIG. 1 and in the enlarged inset marked a-a in FIG. 1, an additional characteristic of intrusion detection system 10, is the positioning mode of sensors 40 wherein they are integrally chained in a parallel configuration on transmission means 50 and in a series configuration arrangement relatively to each other along transmission means 50. Observe in the illustrated example—the way of connecting each one of the sensors to four lines (as shown in the enlarged inset), namely a couple of lines 51 and 52 for the power supply, appropriately marked + and −, and a couple of lines 53 and 54—the communications wires: incoming (receive) denoted Rx and outgoing (transmit) denoted Tx, 53 and 54, respectively, which constitute the above cited transmission means 50.

Any professional would understand that due to the installation of processing components 70 in each one of sensors 40, and in accordance with the accepted and known standards for signals communications of multi users (addressees)—for example RS 485, that may be implemented through transmission means 50, then— paralleled chaining of the sensors and in a parallel configuration as hereinabove described with reference to FIG. 1, enables remote (from the control system) individual identification of each one of the sensors, monovalent (i. e. non equivocal) attribution of the indication that arrives via the transmission means, to a specific sensor—and performing of data communication via said transmission means to each and every specific sensor.

In other words, the identification algorithm of the sensed phenomena (e.g.~vibration) is such that it actually activates when an attempted intrusion is taking place through the physical barrier means or by climbing over it, is resident in sensor 40 and is processed by it (executed by processing component 70). Encoding and classifying the sensed phenomena into an indication data (for example—intrusion act is "happening" or is "NOT happening"), produced and routed via transmission means 50, to control system 60 (that, as would be explained later on, when referring to FIGS. 9 and 10—might be integrated with a regular/common existing alarm system).

Any professional would appreciate the capabilities derived from decentralizing the computerization abilities in intrusion detection system 10 to the end units—namely to sensors 40 themselves (by integrating processing components 70 in each and every one of sensors 40, or at least in part of these sensors 40 that are installed in array 30). So for example—

Decentralizing the computerization ability to the sensors properly, enables one to divide sensors array 30 to groups of sensors 40, wherein each sensor is attributed to a group in which the algorithm of decoding and analyzing of the sensed data is different from that of the algorithm implemented in another group. Thus it is feasible to implement in an intrusion detection system 10 in accordance with the invention, a method of dividing the system into groups of sensors in accordance with various geographic sectors or in accordance with a pre selected mix (planned in advance). Another example—

Decentralizing the computerization ability to the sensors proper, enables—from the instant a sensing activity of a certain effect/phenomenon started by a certain sensor or another—to remotely "awakening" and actuating into operation (for example—from control system 60 or from the sensor that detected the occurrence) of other and additional sensors in the array that were in a rather "sleepy" (stand by) mode till that time while located in the vicinity of the sensor that did sense the phenomena. One more example of a related nature—

Decentralizing the computerization ability to the sensors proper, enables mutual covering up between sensors, neutralizing a localized failure, one or more, in the sensors array—and all this while being able to increase the sensitivity of selected sensors (e. g., adjacent to the failure/malfunction/sensing location) by remote control, in a manner that they will cover up for the faulty sensor or increase the sensing sensitivity in alert situations.

Hence any professional would understand that sensor 40, in which a processing component 70 is installed, enables programming component 70 by communication that arrives on transmission means 50 from control system 60. Sensor 40 enables to vary the version of its software by employing a boot loader mechanism, namely—a special small program that its only job is to load other software for the operating system to start while operated from control system 60.

Any professional would also understand that in the mode of operation of an intrusion detection system 10, there is also embodied a general method for detecting intrusions and warning about them wherein the method comprises the stages of— deploying physical barrier means 20 around the perimeter of an enclosure 25 (or along a border line intended to be protected against intrusion); and deploying multi sensors 40 in an array 30 along physical barrier means 20 and connecting with it, in a manner that enables sensing through array 30 of one phenomena/effect or more that takes place when there is an attempted penetration through physical barrier 20 and/or by climbing on and over it and generating (producing) an indication when such an occurrence is actually sensed; and linking transmission means 50 with sensors array 30 for routing the indication to a distant location; and positioning control system 60 at distance that may be substantial from physical barrier means 20 and linking it with transmission means 50, for receiving the indication and generating a warning about the happening of an attempted intrusion through physical barrier means 20; and wherein the system is characterized by that identifying the one phenomenon or more, as one such that happens when attempted intrusion through physical barrier means 20 and/or by climbing over it is sensed, is performed by applying an algorithm that resides in processing component 70 that is installed in at least one of sensors 40, a processing component 70 that is attributed and integrally allocated to such sensor and enables localized processing of the sensed data of the sensor.

Reference is being made to FIG. 2. FIG. 2 constitutes a schematic view at the block diagram level of an example structure of a vibrations sensor 240. Such sensors might serve in an intrusion detection system 10 in accordance with the present invention (see where referring to FIG. 1).

In accordance with the characteristics of the invention that we discussed above, sensor 240 is integrally installed with processing component 270 that is attributed and allocated to it.

The sensing components that two of them—211 and 212, are installed in sensor 240, might be for example, of the type described in U.S. Pat. No. 7,067,748 of Kelley, Jr. et al. (assigned to SignalQuest, Inc.). Such sensing components are an Omni directional tilt and vibration sensors that contains a first electrically conductive element, a second electrically conductive element, an electrically insulative element, and multiple electrically conductive weights. The first electrically conductive element has a first diameter on a proximate portion of the first electrically conductive element and a second diameter on a distal portion of the first electrically conductive element, where the second diameter is smaller than the first diameter. The second electrically conductive element is similar to the first. In addition, the electrically insulative element is connected to the first electrically conductive element and the second electrically conductive element. The electrically conductive weights are located within a cavity of the sensor, wherein the cavity is defined by surface of the first electrically conductive element, the electrically insulative element, and the second electrically conductive element.

Commercial components that seem to be in accordance with the technology described in above mentioned U.S. Pat. No. 7,067,748 patent are manufactured and marketed by SignalQuest, Inc. The model called by them SQ-SEN—200 might be implemented as sensing components 211 and 212 in sensor 240. SQ-SEN—200 are small dimensions sensing component, impervious to water and dust, that enables mounting in any desired angle without detracting from his sensitivity.

In the illustrated example, two sensing components 211 and 212 are installed in sensor 240. The provision of plurality of sensing components within one sensor, obviously improves the reliability of the sensor because it enables to implement an identification algorithm that identifies sensed phenomena of vibrations as the one that happens when attempted break in through the physical barrier means 20 or by climbing over it is actually happening—by relying on information that is received from more than one sensing component.

In the illustrated example (FIG. 2), the two sensing components 211 and 212 are installed as they are orthogonal (perpendicular) one to the other. It s easily understood that such a mounting improves the sensitivity of the sensor in case that the sensor has a directional sensitivity.

As said, a processing component 270 is installed in sensor 240 and enables localized processing of the sensed data reported by the sensing components. Namely, the identification and analyzing algorithm for the vibrations and shocks effects as such as is given when an attempted break in occurrence through the barrier means or by climbing over it was taking place may be programmed in processing component 270. This identification and analyzing algorithm may be based on analyzing events that occurred within the framework of an adjustable "time window" that may be, for example—0.5 sec to 10 seconds. Any professional would understand that the algorithm may be based, in addition, also on the analysis of events (relevant ones and also just interference in tandem) through measuring their duration while filtering incidents expressed by short pulses (for example, a random shock) or cyclic (such as vibrations created by e.g.—a passing train).

According to some embodiments, the system, such as system 10 of FIG. 1, may include means for performing active initiated self test by generating vibrations to be detected by one or more sensors, such as sensors 40 of FIG. 1 or sensor 240 of FIG. 2. These means may be functionally associated with one or more sensor (for example, each means may be an integral part of the sensor(s) or an individual component). These means may be remotely operated from a control system, such as control system 60 (see above, referring to FIG. 1).

For example, Sensor 240 is characterized by that that it includes—in addition, means 221 for performing active initiated self test by generating vibrations.

In the illustrated example, means 221 for performing active initiated self test is a "coin vibrator", namely for example—a small tiny vibrator, of the type that is installed in a cellular phone for generating vibrations as an indication for incoming calls when the phone is in its quite mode).

Any professional would understand that means 221 for performing active initiated self test, might be remotely operated from the control system 60 (see above, referring to FIG. 1).

Any professional would appreciate the capability instilled by the integration of means 221 as part of sensor 240—that at any instant in time, the control system can initiate actuation of means 221, utilizing it to produce a practical likeness of the vibrations phenomenon the sensor is ought to sense at a time of an attempted intrusion. Even the vibration profile may be controlled and commanded due to the basic fact that means 221 are operated through processing component 270.

This capability enables to accurately calibrate system 10 and the execution of serviceability tests of the system. When the activation of means 221 is remotely preformed from control system 60, then one skilled in the art would appreciate the fact that this vital capability is available and accessible at any given time and in a manner that does not necessitates the system's examiner to approach the physical barrier means (thus avoiding the risk of being dangerously exposed).

Any professional would also understand that one or more of such means for active initiation of a self test as said, might be packaged individually (separate from the components of the sensors in the system). In other words, along the multi sensors array of the system and on the same transmission means 50, there might be located also several dedicated components whose sole task is to produce a practical semblance of vibrations phenomena that like it or similar to it the sensor might sense ("feel") at an instant of attempted intrusion. Phrased differently, it can be said that it is feasible to install dedicated means for performing active initiated self tests as said in accordance to selected sectors (or to install means as said, but only in a part of the sensors of the system).

Any professional would also understand that a vibrator, such as a cell phone vibration motor (a "coin vibrator"), requires a considerable amount of electrical energy. This problem is significantly increased due to the length of the sensor line (for example, up to about 250 sensors), each requiring a vibration motor.

Each sensor typically requires 230 uA in a standard working mode. The maximal current consumed by each sensor unit in a full length chain of 875 m (250 sensors×3.5 m) and with a minimal input power of a Lead-Acid 10.2V battery is 330 uA. This leaves only 100 uA for the "coin vibrator".

According to some embodiments, there is provided means for performing active initiated self test by generating vibrations comprising a supercapacitor that may be charged during relatively long periods of time (when the means for self test are not operated) and discharged very rapidly (during activation). This may allow saving a significant amount of energy. It is also possible to remotely control the timing of charging and discharging of each capacitor independently (by phase shifting) and thus to further reduce the consumption of energy.

An example of such capacitor may include a supercapacitor provided by the CapXX company, having capacitance of 75 mF, working voltage of 4.5 V and dimensions of 20 mm×15 mm×2.2 mm. The supercapacitor may be discharged at a maximal current of 30 A. This supercapacitor may be used as an energy source to a "coin vibrator", of the type that is installed in a cellular phone, for example, a coin vibrator having a diameter of 10 mm, thickness of 3 mm, operating voltage 3 VDC, 12000 RPM, initial current consumption of 150 mA and constant consumption of 100 mA.

The supercapacitor charging and discharging channels may be separated so that charging rate can be determined and controlled regardless of the discharge. In addition, the discharge current consumed by the "coin vibrator" does not affect the current consumed by the sensor itself.

Reference is now made to FIGS. 11 and 12, which constitute schematic views of a block diagram of means for performing active initiated self test by generating vibrations (illustrated in a "motor ON" open switch position and in a "motor ON closed switch position, respectively).

According to some embodiments of the invention, unit 1100 includes a supercapacitor 1102, a vibration motor 1104 and two pins, A/D pin 1106 and I/O pin 1108. A/D pin 1106, which is the input channel to an A/D convertor of a microcontroller, is adapted to provide an indication regarding the level of charging of supercapacitor 1102. I/O pin 1108 is adapted to charge the supercapacitor through a resistor 1110, which is adapted to limit the charging (and discharging) current of supercapacitor 1102. I/O pin 1108 is further adapted to control a switch 1112 of vibration motor 1104. When the micro-controller is excited, if the node position of I/O pin 1108 is defined as OL (Output Low) mode, discharging of supercapacitor 1102 (if it was charged) is performed and no continence charging is possible. When a signal to start charging is received from a central control unit, the node position of I/O pin 1108 shifts to OH (Output High) mode and charging starts.

Upon a signal from the central control unit a voltage reading indicating the charging state of supercapacitor 1102 may be obtained. When the voltage reaches a level that allows activation of vibration motor 1104, a command for self test of the sensor may optionally be executed. Upon receiving the self test command, the node position of I/O pin 1108 shifts to OL (Output Low) mode, charging of supercapacitor 1102 is stopped and switch 1112 (which was "opened" as shown in FIG. 11) is closed (as shown in FIG. 12) and vibration motor 1104 is activated. Vibration motor 1104 operates for a certain period of time until: a) the node position of I/O pin 1108 shifts to OH (Output High) mode, vibration motor 1104 stops and charging continues or b) the voltage of supercapacitor 1102 decreases below the operating voltage of vibration motor 1104.

Additional components that appear in FIG. 2, are presented below—Filter components 231 and 232 that are linked to the sensing components 211 and 212 (respectively), and wherein any professional would understand that they constitute hardware filters that perform filtering and shaping of the wave forms obtained from the sensing components.

Filter components 231 and 232 are linked, each one of them, to processing component 270 at timing entrances 241 and 242, respectively and at counter controlled entrances (251 and 252, respectively). The obtained data is therefore fed to processing component 270.

Component 261 is a voltage regulator that serves to regulate the electricity power supply to the sensor (through transmission means 50—see FIG. 1).

Driver component 281 serves the entering (received—Rx) and the exiting (transmitted TX) communication to and from the sensor (signal communication that is also conveyed through transmission means 50—see FIG. 1).

Reference is being made to FIGS. 3 and 4. FIG. 3 constitutes a front view of sensor 340 for sensing vibrations as in the example that was illustrated in FIG. 2, wherein it is provided on a printed circuit 341. FIG. 4 constitutes a rear view of the same printed circuit 341 that on it sensor 340 is provided.

Any professional will appreciate the possibility of mounting the sensor components on a printed circuit. Thus the sensor might be manufactured in an industrial process—automated (mechanized) and swift, as is common in the printed circuits industry, in a multi sensors configuration—one next to the other. Later on, by employing communication connectors for testing (316 and 416) that are formed on the printed circuit on its two ends (one on each), it is possible to operationally test the manufacture red sensors by their locations—one adjacent to the other, in a test bed—an installation with a multi brackets fixture (that is not illustrated).

The remainder of the sensor components are also shown as located on printed circuit 341. They include the sensing components 311 and 312, one combined filters' component 331, processing component 370 (which might be for example a microchip type processing component 16F684), a voltage regulator component 461, a driver component 381, frequency oscillator 383 and brackets arrays 490 and 495 that, as would be explained herein after (when referring to FIG. 5)—serve for connecting the sensor with the transmission means of the system.

Sensor 340 is formed with connector means 326 enabling outside—external—programming of processing component 370 using the connector for a booting operation of software through the communication link provided by connector means 326.

Any professional would understand that wherein the sensor is of the type that in accordance with another preferred embodiment of the invention includes also means for performing active initiated self test (note that in the illustrated example, sensor means 340 does not include such means), then also that means might be actuated by local connection to connector means 326.

In the illustrated example, bores array 336 is formed between connector means 326 and the printed circuit's body, constitutes a kind of a (gradually) weakening section that enables breaking off connector means 326 from the body of the printed circuit (from the time the updating of the software or the tests are completed).

Reference is being made to FIG. 5. FIG. 5 constitutes a view of printed circuit 341 connected to transmission means 550.

Transmission means 550 serves, as cited earlier, as the communication cable to sensor 340 and from it and as the electricity power supply cable to sensor 340. The configuration of transmission means 550 is of plurality of sectors of cable (typical end sections of two of them—550' and 550" are illustrated in the figure). In the illustrated example, each sector of the cable is interwoven of four (4) wire strands along its length—two for passing the supply electricity power and two for the sensor communication: one for incoming communication (receive—Rx) and one for the outgoing one (transmit—Tx).

From the instant that the examination of the printed circuit 341 was completed, it is feasible to anchor the ends of the cable's sectors to the circuit, for example by using adjustable bands 505 and 506 that fasten the cables to the printed circuit 341, and to connect the strands to the printed circuit, for example by soldering them unto the brackets arrays 490 and 495.

Reference is being made to FIG. 6. FIG. 6 constitutes a view of vibration sensor 340; the one whose components provided on printed circuit 341 were illustrated in FIGS. 3 and 4 and its view as it is linked to transmission means 550 was illustrated in FIG. 5, wherein it is encapsulated in polymeric material 611 that was cast around it.

Any professional would appreciate the capability (as described above) to manufacture the sensor 340 by an industrialized process, highly automated, while being able to instill capabilities of performing quality and serviceability examinations in the course of its manufacturing process, and as an assembly that does not contain moving parts (and its outcome—an assembly that is not prone to suffer mechanical failures).

Any professional would also appreciate the capability to execute encapsulation of sensor 340 in a manner that would enable its conformance with IP code 68 as defined in international standard IEC 60529. The standard that classifies the degrees of protection provided against the intrusion of solid objects, dust and water in electrical enclosures (the letters IP for "international protection rating", sometimes also interpreted as "ingress protection rating"). Therefore, sensor 340 is able to be dust tight with no ingress of dust and complete protection against contact and to withstand immersion beyond a depth of 1 m of water. Sensor 340 might be suitable for even continuous immersion in water in such a manner that produces no harmful effects, which normally, will mean that the sensor is hermetically sealed. Alternatively sensors 40 should withstand IP code 67—i.e., the sensor will be capable to be dust tight with no ingress of dust and complete protection against contact and to withstand immersion in depth of up to 1 m of water, Ingress of water in harmful quantities shall not be possible when the sensor is immersed in water under defined conditions of pressure and time (including up to a depth of 1 m submersion).

Encapsulation of sensor 340 might be performed by using polymeric materials (for example—polyurethane or epoxy) that have a relatively high durability in fire and are self-extinguished (conforming with standard UL 94V0 defining burning stops within 10 seconds on a vertical specimen; no drips allowed, and thus it is possible to achieve survivability of the system even under severe inclement environmental conditions and increase its durability against extending (advancing) of the fire along the transmission means wires.

In the illustrated example, connector means 326 is left as it is protruding from the body of the cast sensor (and enables to perform tests and examination and/or software updating etc., from near by). Any professional would understand that while referring to FIG. 6 we are elaborating solely on an example and those sensors in accordance with the invention might also not include protruding connector means as just described. In accordance with the illustrated example, connector means 326 is given to being intentionally braked away and severed from the sensor (using an array of bores or any other type of perforation 336, and see above when referring to FIGS. 3 and 4).

Of course, after disconnecting and separating the connector means 326, it is important to remember and ensure a new sealing of the sensor (for example, by spreading a sealant on the location of the breaking off area).

Any professional would appreciate the fact that an intrusion detection systems in accordance with the present invention enables mounting and integration of sensors of varied and different kinds, in a manner that this enables sensing with such an array of different sensors, different phenomena's that take place when an attempted intrusion through the physical barrier is preformed. The system is therefore capable of producing suitable indication upon sensing of several types of phenomena's (depending on the types of the sensors mounted along its transmission means). For example—

Sensing the phenomenon of a strain variations occur in taut wires (when the physical barrier means is a taut wire fence or a combination of a taut wire with any kind of another physical barrier). As is well known, variations in the wires strain might happen as an outcome from cutting, bending or spreading of the fence's wires when an intrusion attempt is in process.

It is possible to detect variations in the strain of the wires using a "tension sensor" strain gage. Any professional would understand from the description of the infrastructure of the multi sensors array 30, the transmission means 50 and the control system 60 that the system in accordance with the invention enables the added integration of strain gages based type of sensors, as the sensors that are installed in the array (all of it or only part of it—alongside other and different sensors). As said, installing a processing component 70 in the sensor itself enable flexibility in terms of communication tasks and generating of indications adapted to be routed along unified infrastructure—over the same transmission means that may serve for routing indication from other and different sensors within the same system.

Reference is being made to FIGS. 7 and 8. FIG. 7 constitutes an illustration of an intrusion detection system 710 in accordance with yet additional embodiment of the present invention, in which a sensor 740 for sensing strain changes that is based on a strain gage device is integrated with a spatial array 720 of taut wires 721. FIG. 8 constitutes an illustration of intrusion detection system 710 that was illustrated in FIG. 7, wherein it is installed on a physical barrier means 820 of the rigid wires grid type.

Sensor 740 includes anchoring means 712 (in the illustrated example—embodied in the configuration of a ring 714 with bores 716 around its circumference).

Anchoring means 712 is coupled with spatial array 720 of several taut wires 721 that are anchored to bores 716 and therefore spatially stretched from ring 714.

In the illustrated example, anchoring means 712 is connected to the spatial array 720 of taut wires 721 while using springy means 732 (in the illustrated example—spiral springs 734), wherein each one of them is harnessed, on its one side to one of the stretched wires 721 and on its other side to the anchoring means 712 (via bores 716).

Anchoring means 712 is positioned so that it protrudes out of the sensor 740 outer surface at the top head of a pole 742. Any professional would understand that it constitutes the measurement base unto which the strain gage (that is not illustrated) is connected.

Any professional would understand that in this configuration, one single sensor focuses to it something like a "spider's cobweb"—namely plurality of taut wires that enable to form a spatial physical barrier means.

It is as well also understood that—in using the term spatial it is not meant to be only a planar and flat wires array (such as the array that is illustrated in the example) but rather it might also be implemented with a depth dimension).

Installing a processing component in sensor 740 (as the present invention characteristic feature dictates) enables calibrating the sensor (at any given moment, by a remote posted command conveyed from the control system or as a self initiated automatic command), in accordance with the given situation in which taut wires 721 are biasing pole 742 that—as said, constitutes the measurement base unto which the strain gage (that is not illustrated) is connected.

In other words, from the instant the anchoring act of the tout wires unto the sensor was completed and the system is spatially balanced, installing a processing component in the sensor (as a characteristic of the system), enables specific adaptive calibration of the spatial array in accordance with the given state.

Balancing the taut wires array that are stretched from anchoring means 712 that is positioned at the top of pole 742, renders the pole to act as a "joy stick", wherein biasing it as an outcome of the attempted intrusion through the taut wires array or by climbing over it—is detectable through the strain gage (that is not illustrated) and that is coupled to it.

An additional aspect that is illustrated in FIG. 8, is the anchoring means 821 that in the illustrated example serves for anchoring intrusion detection system 710 unto an additional physical barrier 820 of the rigid wires grid type.

Any professional would understand that the sensors (40, 240, 340 and 740) that were described hereinabove while referring to the accompanying figures mandates anchoring for connecting to and coupling with the physical barrier means. The anchoring means might be, for example, a double sided adhesive strip that enables swift deployment of array 30 (see where referring to FIG. 1), over a physical barrier such as a wall or flat surface, adjustable clamps or bands that enable anchoring the sensor to a physical barrier such as a grate or rigid fence, or also a magnet that is embedded in the body of the sensor and enables fast flush mounting of array unto a metallic body.

In the illustrated example of FIG. 8, anchoring means 821 includes an extended bracket 823 that is formed in advance along and inside the cast body of sensor 740. Bracket 823 is suited in its dimensions for coupling with the profile of the rigid wires grid 820. Two adjustable band clamps 825 and 827 serve to fasten sensor 740 to the grid's profile.

Any professional would also understand that in the configurations described in FIGS. 7 and 8, sensor 740 might be installed, in addition, also with a vibrations sensor in order to provide indications that are based on sensing two potential intrusions related phenomena's simultaneously (vibrations in addition to the taut wires strain changes).

As per additional examples of sensors in accordance with the present invention, will be installed, each one (of them) with a processing components and hence would enable their integration in an infrastructure of a multi sensors array, over a single and only one unified transmission means, and all of them would be adaptable to communicate with the same control system and over said unified transmission means, are— a sensor that senses a body approaching to the physical barrier (for example an ultra sonic sensing/detecting sensor), a sensor that enables listening (audio) to what is happening in the vicinity of the physical barrier (for example using a microphone), a sensor enabling video display (visualization) of what is happening near the physical barrier means (for example, using a tiny pin hole camera).

Any professional would also understand that the same infrastructure of multi sensors array, single and unified transmission means and control system, and the present invention characteristic of installing a processing components in each of the sensors, enable an integration of active means as an integral part of a sensing sensor or alongside said sensing sensor within the same intrusion detection system. For example—

Means for generating sound (for example high frequency whistling or honking, for deterring or driving away animals from the physical barrier means), means for sprinkling liquid or releasing gas (for example, smelling liquid to drive away animals, marking paints, smoke or tear gas), means to trigger a (light) flash for obtaining a "they photographed me" feeling to deter intruders.

Any professional would appreciate the fact that by interlacing a whole variety of sensing technologies in a multi sensors array of intrusion detection systems in accordance with the invention, it is feasible to upgrade and increase the reliability level of the system and its immunity against countermeasure, tampering and disrupting means.

In an example of intrusion detection system 10 as illustrated in FIG. 1, the communication from sensors 40 along transmission means 50 and from it to a control system 60 (see there, the arrow marked 65) is based on EIA-485 (formerly RS-485 or RS485). It is a well known OSI model of a physical layer electrical specification of a two-wire, half-duplex, multipoint serial connection. EIA-485 is a well known and reliable standard that specifies a differential form of signaling. The difference between the wires' voltages is what conveys the data. One polarity of voltage indicates logic 1 level, the reverse polarity indicates logic 0. The potential difference must be at least 0.2 volts for valid operation, but any applied voltages between +12 V and −7 volts will allow correct operation of the receiver. EIA-485 enables the configuration of inexpensive local networks and multidrop communications links. It offers high data transmission speeds (35 Mbit/s up to 10 m and 100 kbit/s at 1200 m) and it can span relatively large distances (up to 1200 meters).

Similarly, any professional would understand that it is possible to implement—as the system's communication from sensors 40 along transmission means 50 and from it to control system 60—also a wireless type of communication technology and therefore turning intrusion detection systems in accordance with the present invention, or at least a sector of it, into a wireless communication type of fence, endowed with an IP address (or Internet Protocol address) or in other words—a unique address that control system 60 would use in order to identify and communicate with sensors array 30 on a computer network utilizing the Internet Protocol standard (IP). All that is required for this purpose is the connection of the transmission means 50 (that might operate, for example in RS485) into a Wi-Fi converter (Wi-Fi—the common name for a popular wireless technology which is supported by nearly every modern personal computer operating system). In such a way, the system (all of it or one sector of it) will be converted into an implementation of other known RF medium.

To the same extent, any professional would understand that it is feasible to perform the communications from sensors 40, along transmission means 50 and from it to control system 60, based on Ethernet RS422 which is a well known frame-based computer networking technology for local area networks (LANs), that defines a signaling standards for the physical layer, through means of network access at the Media Access Control (MAC)/Data Link Layer, and a common addressing format. Wherein RS422 or American national standard ANSI/TIA/EIA-422-B and its international equivalent ITU-T Recommendation V.11 (also known as X.27), are technical standards that specify the "electrical characteristics of the balanced voltage digital interface circuit". It provides for data transmission, using balanced or differential signaling, with unidirectional/non-reversible, terminated or non-terminated transmission lines, point to point, or multi-drop. In contrast to RS-485 (which is multi-point instead of multi-drop) EIA-422/V.11 does not allow multiple drivers but only multiple receivers.

Several key advantages offered by this standard include the differential receiver, a differential driver and data rates as high as 10 megabaud at 12 meters (40 ft). The maximum cable length is 1200 m. Maximum data rates are 10 Mbit/s at 12 m or 100 Kbit/s at 1200 m.

Reference is being made to FIG. 9. FIG. 9 constitutes an illustration of an additional embodiment 910 of an intrusion detection system in accordance with the present invention, wherein the system is integrated with an existing alarm system 911.

An intrusion detection system in accordance with the present invention (in a different configuration—hence another embodiment) enables in addition, interfacing with common (i. e., commercial) alarm systems. In the illustrated example, two transmission lines, namely 950' and 950" are parallel connected with a control system 960 that in the illustrated example is an adapter means 961 that in its turn serves as the interface of the system with alarm system 911. Adapter means 961 is amenable to programming and control through being contacted by computer 963 with it. Adapter means 961 is suited to generate indications that are identified and recognized by alarm system 911, that in its turn, decodes and classifies (sorts) them in accordance to its inherent pre-existing criteria (for example—as a warning that mandates its transmission to a distant entity—a hub, an exchange and/or a telephone number).

In the illustrated example, alarm system 911 has inherently useful combined capabilities such as an audio (voice) warning (buzzer 913) as well a transmitting in a wireless medium and/or in the WEB 915, and transmitting a warning over line 914 to a distant subscriber 916. In addition the alarm system comprises a control panel 917.

Reference is finally being made to FIG. 10. FIG. 10 constitutes a schematic view at the block diagram level of an example structure of an adapter means 961 that enable interfacing of an intrusion detection system 910 with an existing alarm system 911 (as illustrated in FIG. 9).

Adapter means 961 is a HUB circuit that comprises—

Driver component 1011 that serves incoming communication Rx (receive) and outgoing one Tx (transmit) from transmission means 950' and 950", a communications adapter 1013 connected to it, a programmable processor component 1015 that is connected to communications adapter 1013 and serves for coordinating the communication protocols, communication adapter 1017 that is also connected to processor component 1015, driver component 1019 that enables connecting in a complete assembly (cascade) with an additional adapter means, USB driver component 1021 that enables programming and controlling of adapter means 961 (by the computer 963 contacting it and see above, with reference to FIG. 9), timing (clock) component 1023 and external memory component 1025 that are both linked with processor component 1015, power supply 1027 for providing electricity to adapter means 961, communication means 1029 for performing communication with alarm system 911 (in a protocol recognized by it), and programming enabling component 1031 that is also linked with processor component 1015 that enables through dip switches 1033 and dry contact relay 1035 array altering the sensitivities of sensors in accordance with their address, issuing command to drivers means that are regularly connected with the alarm system 911 (for example—electrical gate, camera, light projector/searchlight etc.).

Any professional would appreciate this capability of intrusion detection system 910 to be integrated as an "add on" system that is added to existing alarm system 911 without a need for an additional complicated and expensive infrastructure, but rather as a modular extension system to such commercially available alarm system 911. Intrusion detection system 910 is combined to alarm system 911 similar to just adding a new "detector" to an existing alarm system, a new "detector" that "knows" how to communicate with the preexisting alarm system while utilizing the original communication protocol of the alarm system.

Any professional would understand that, based on the technology of the intrusion detection system that was described above, while referring to the accompanying figures, it is also possible to implement a rather "strapped down" version of the innovative system that utilizes the components of the multi sensors array, the one (single) unified transmission means and the control system—all as described hereinabove, in applications that do not necessitate a physical barrier means (but, in contradistinction, can well serve where sensing capabilities are needed along a relatively long path or trail.

For example, a system that would be in accordance with the present invention but without deploying a physical barrier means, might be implemented with temperature sensors and/or smoke sensors and serve for early detection of an outbreak of a fire in a forest while providing with the ability to "pinpoint" the fire outbreak location.

Another example—a system that would be in accordance with the present invention but without the presence of a physical barrier means, might be implemented with metrology (weather) sensitive sensors (for example a sensor to measure humidity temperatures and wind speeds) prevailing in a desired sector.

Another example—a system that would be in accordance with the present invention but without the presence of a physical barrier means, might be implemented with vibration sensors wherein it is linked to a long infrastructure which has to be protected against intrusion into it, for example hidden in the ground on the side of and along a piping or cast along the perimeter of the walls of the safe deposit boxes room of a bank.

And yet another example—a system that would be in accordance with the present invention but without the presence of a physical barrier means, might be implemented with acoustical sensors wherein it is associated with the flow of a liquid, and warns against occurrence of variations in the flow, e. g. fast, strong impeding flow preceding flood (in correlation with acoustic phenomena that accompany such situations).

Any professional would understand that the present invention was described above solely in a way of presenting examples, serving our descriptive needs and those changes or variants in the structure of the intrusion detection system, its sensors and its method of construction and operation—the subject matter of the present invention, would not exclude them from the framework of the invention.

In other words, it is feasible to implement the invention as it was described above while referring to the accompanying figures, also with introducing changes and additions that would not depart from the constructional and operational steps, characteristics of the invention, characteristics that are claimed herein under.

The invention claimed is:

1. An intrusion detection system, that comprises:

a physical barrier means deployable around a perimeter of a defined site or along a border line intended to be protected against intrusion; and a multi sensors array deployable along said physical barrier means and linkable to said physical barrier means in a manner that enables sensing at least one of various phenomena through said array, wherein said phenomena typically take place when an attempted intrusion act occurs through said physical barrier means, and generation of an indication when a phenomenon as said is sensed; and a transmission means linkable to said sensors array, for routing said indication to a remote site; and a control system that can be positioned at the remote site and that is linkable with said transmission means, for receiving said indication and generating a warning of an occurrence of an attempted intrusion through said physical barrier means;

wherein at least one sensor of said multi sensors array contains a processing component that belongs and is specifically allocated to said at least one sensor and enables local analyzing of said phenomena within said at least one sensor;

wherein at least a part of said multi sensors array are vibration sensors for sensing vibrations phenomena that occur when there is an attempted intrusion through said barrier means;

wherein at least one of said vibrations sensors is functionally associated with means for executing active initiation self tests adapted to produce sensible vibrations to be detected by one or more of said vibration sensors;

wherein said means for executing active initiation self tests comprise a supercapacitor adapted to be charged when said means for executing active initiation self tests is not operated and discharged upon activation of said means for executing active initiation self tests; and wherein discharging of the supercapacitor triggers activation of a vibration motor.

2. An intrusion detection system in accordance with claim 1, wherein said at least one sensor equipped with said processing component enables programming said processing component by communication arriving over said transmission means from said control system.

3. An intrusion detection system in accordance with claim 1, wherein said at least one sensor equipped with said processing component comprises in addition:

a connector means for enabling locally programming of said processing component through a communication arriving from said connector means.

4. An intrusion detection system in accordance with claim 1, wherein said at least one sensor equipped with said processing component is integrally chained in a parallel configuration on said transmission means and each of the at least one sensor is in a series configuration one to another along said transmission means.

5. An intrusion detection system in accordance with claim 1, wherein said multi sensors array integrates two or more types of sensors enabling sensing of various types of said phenomena that typically occur when an attempted intrusion is in progress through said barrier means, and generating indications when said various types of said phenomena are sensed.

6. An intrusion detection system in accordance with claim 5, wherein said two or more types of sensors are selected from a group consisting of sensors for sensing vibrations and shocks, sensors for sensing variations of tension in taut wires, sensors for sensing approaching bodies, and sensors that enable, in addition to or separately from said sensing—listening, displaying video, producing a voice, operating means for sprinkling gas or liquid, generating a light flash or a combination thereof.

7. An intrusion detection system in accordance with claim 1, wherein said means for executing active initiation self tests comprise a coin vibrator.

8. An intrusion detection system in accordance with claim 1, wherein said means for executing active initiation self tests comprise a plurality of means for executing active initiation self tests adapted to produce sensible vibrations to be detected by one or more of said vibration sensors;

each of said plurality of means comprises an individual supercapacitor adapted to be charged when corresponding means of said plurality of means are not operated and discharged upon activation of corresponding means of said plurality of means; and wherein each of said plurality of means is adapted to be independently activated and wherein discharging of the individual supercapacitor triggers the activation of the vibration motor.

9. An intrusion detection system in accordance with claim 1, wherein said means for executing active initiation self tests is operable by remote control from said control system.

10. An intrusion detection system in accordance with claim 1, wherein said means for performing active initiation self tests is operable by getting locally hooked to said at least one of said vibration sensors.

11. An intrusion detection system in accordance with claim 1, wherein said means for executing active initiation self tests comprises dedicated components separate from said multi sensors array solely dedicated to producing vibrations, wherein said dedicated components are linked with said transmission means and installed with a processing component that belongs to and is specifically attributed to said dedicated components.

12. An intrusion detection system in accordance with claim 1, wherein:

said physical barrier means is, at least partly, formed with taut wires; and at least one sensor of said multi sensors array is a sensor for sensing variations of tension in said taut wires that occur when there is an intrusion attempt through said wires.

13. An intrusion detection system in accordance with claim 12, wherein said sensor for sensing variations of tension uses a strain gauge to sense variations of tension in said taut wires.

14. An intrusion detection system in accordance with claim 13, wherein said sensor for sensing variations of tension includes anchoring means that is linked with a spatial array of a plurality of said taut wires that are stretched from said anchoring means.

15. An intrusion detection system in accordance with claim 14, wherein:

said anchoring means protrudes from above said sensor for sensing variations of tension; and is linked as said with said spatial array of said plurality of said taut wires through springy means wherein each of said springy means is harnessed—on a first side, to one of said taut wires, and on a second side to said anchoring means.

16. An intrusion detection system in accordance with claim 1, wherein said control system includes an adapter means for interfacing said intrusion detection system with an existing alarm system.

17. A sensor that is installable in a system in accordance with claim 1, that includes:

at least one sensing component;

a filter component linked with said sensing component;

at least one communication connector, for running tests;

wherein said sensing component, said filter component, said communication connector, and said processing component are all provided on a printed circuit; and said printed circuit is encapsulated within cast polymeric material.

18. A method for detecting intrusions comprising:

deploying a physical barrier means around a perimeter or along a border line that are intended to be protected against intrusions;

deploying a multi sensors array along said physical barrier and connecting with it, in a manner that enables sensing by said array one single phenomena or more, that typically occur when a break in is attempted through said barrier means, and generating a suitable indication when said phenomena was sensed;

linking line transmission means with said sensors array for routing said indication unto a remote site;

positioning a control system at said remote site from said physical barrier means and linking it with said line transmission means, in order to receive said indication and generate a suitable warning of an attempted intrusion occurrence through said barrier means;

determining whether sensed data comprises said phenomena that occur when an intrusion is attempted through said barrier means while implementing an algorithm that resides in a processing component that is installed in at least one sensor of said multi sensors array and enables localized processing of received sensed data from said at least one sensor; and executing active initiation self tests by producing with a vibration motor sensible vibrations to be detected by one or more sensor of said multi sensors array, wherein the vibration motor is activated by discharging a supercapacitor that is charged while not executing active initiation self tests and discharged while executing active initiation self tests.

* * * * *